US007059341B2

(12) United States Patent
Kumar et al.

(10) Patent No.: US 7,059,341 B2
(45) Date of Patent: Jun. 13, 2006

(54) DISCHARGE DUCTS FOR PUMPING WATER FROM A SUPPLY RESERVOIR TO A DELIVERY RESERVOIR

(76) Inventors: Srivastava Ramesh Kumar, 3A, Melody Society, ICS Colony, Pune 411007 (IN); Joshi Shashikant Gangadhar, A-7, Aishwarya Apartment, 92-Rambaug Colony, Paud Phata, Pune 411038 (IN); Kshirsagar Jagadish Trimbakrao, Flat No. 201, Building A, Mont Vert-Altesse, Survey No.129/2, Pashan-Sus Road, Pashan, Pune 411021 (IN); Gunaseelan Sathianathan, B-4, 402 Lunkad Colonade-1, Viman Nagar, Pune 411014 (IN)

( * ) Notice: Subject to any disclaimer, the term of this patent is extended or adjusted under 35 U.S.C. 154(b) by 0 days.

(21) Appl. No.: 10/937,588

(22) Filed: Sep. 9, 2004

(65) Prior Publication Data

US 2005/0058511 A1 Mar. 17, 2005

(30) Foreign Application Priority Data

Sep. 12, 2003 (IN) ..... 953/MUM/2003

(51) Int. Cl.
*F16K 24/00* (2006.01)

(52) U.S. Cl. ..... 137/143; 137/216; 137/197

(58) Field of Classification Search ..... 137/197, 137/216, 143
See application file for complete search history.

(56) References Cited

U.S. PATENT DOCUMENTS 967,512 A * 8/1910 Gregory et al. ..... 73/198
3,763,887 A * 10/1973 MacVey et al. ..... 137/565.3
5,123,438 A * 6/1992 Henderson ..... 137/255
5,199,455 A * 4/1993 Dlouhy ..... 137/217

* cited by examiner

*Primary Examiner*—Sunil Singh
(74) *Attorney, Agent, or Firm*—Charles A. Muserlian

(57) ABSTRACT

A discharge duct for discharging pump water from a supply reservoir defined by a first minimum water level and a supply reservoir floor to an operatively higher located delivery reservoir defined by a second minimum water level and the delivery reservoir floor, the discharge duct being defined by an inlet at one end of the discharge duct in communication with the outlet orifice of a conventional pumping device fitted at the supply reservoir; an outlet at the other end of the discharge duct, in the operative configuration of the discharge duct, being below the second minimum water level.

5 Claims, 18 Drawing Sheets

DISCHARGE DUCTS FOR PUMPING WATER FROM A SUPPLY RESERVOIR TO A DELIVERY RESERVOIR

The invention relates to discharge ducts for pumping water from a supply reservoir to a delivery reservoir.

In particular this invention relates to a method to minimize head loss in discharge ducts between a supply and a delivery reservoir.

The overall head acting on a pump is the sum of static water level difference in suction and delivery reservoirs of a pumping system, the dynamic head difference at suction and delivery and the losses in the ducting.

In the case of very large flow pumping system, the losses are of prime importance as any increase in pumping head due to friction, obstructions like valves including non return valve and the like could cause a sizeable power loss.

Typical parameters are provided in the below shown tables:

For a single discharge duct in the conventional system

| DESCRIPTION | PARAMETERS |
|---|---|
| Flow, m3/s | 1 |
| Pipe size, mm | 500 |
| Head loss due to butterfly valve, m | 0.36 |
| Head loss due to non-return valve, m | 0.385 |
| Power loss due to butterfly valve, kW | 3.53 |
| Power loss due to non-return valve, kW | 3.7 |
| Total power loss, kW | 7.03 |
| Total energy loss per year, kJ | 64,000 |

Similar parameter for multiple discharge ducts

| DESCRIPTION | PARAMETERS |
|---|---|
| Flow, m3/s | 20 |
| Pipe size, mm | 3000 |
| Head loss due to butterfly valve, m | 0.1 |
| Head loss due to non-return valve, m | 0.2 |
| Power loss due to butterfly valve, kW | 19.62 |
| Power loss due to non-return valve, kW | 39.24 |
| Total power loss, kW | 58.86 |
| Total energy loss per year, kJ | 5,80,550 |
| Indian Rupees per Kw/hour | 3/- |
| Total cost due to presence of valves, in Indian Rupees per year per pump | 15,25,000/- |

The method and apparatus of this invention seeks to obviate the problems that might be faced at the start of the pumping system and in the event of a sudden stoppage of the pumping system such as from a power failure.

Another object of this invention is to devise a system and a discharge duct which does not need non return valves and butterfly valves.

Still another object of this invention is to provide a system which has a reduced head and therefore reduces energy losses during operation.

Though the system of this invention looks very simple it is associated with complex flow phenomenon like, entrapment of air during starting of the system and flow reversal in case of power failure due to siphon action which have to be obviated.

According to this invention there is provided a discharge duct for discharging pumped water from a supply reservoir defined by a first minimum water level and a supply reservoir floor to an operatively higher located delivery reservoir defined by a second minimum water level and the delivery reservoir floor, the said discharge duct being defined by:

an inlet at one end of the discharge duct in communication with the outlet orifice of a conventional pumping device fitted at the supply reservoir, an outlet at the other end of the discharge duct, said outlet, in the operative configuration of the discharge duct, being below the second minimum water level;

a peak at a location relatively closer to the delivery reservoir and at a height between h+2d+0.5 meters and h+2d+8 meters where h represents the height difference between the floor levels of the supply reservoir and the delivery reservoir and 2d represents the diameter of the cross section of the discharge duct;

inclined sections leading from the peak towards the said inlet and the said outlet, the angle of inclination of the inclined sections leading to the said outlet and the said inlet being at an angle lying between 45 and 60 degrees to a virtual central axis [B—B] passing through the said peak;

a siphon breaking orifice provided at the peak or within five degrees of the peak towards the delivery reservoir; and an evacuator orifice provided at a location on the inclined section leading from the peak towards the said outlet at a position 10 to 17 degrees off the peak towards the delivery reservoir.

Typically, the discharge duct is arcuate at the peak.

Typically, a pneumatic controlled valve with a separate power back up is fitted to the siphon breaking orifice.

In accordance with a preferred embodiment of the invention a vacuum pump is provided at the evacuator orifice.

In accordance with another aspect of this invention, there is provided a method of delivering water through a discharge duct from a supply reservoir to a delivery reservoir located at a level operationally higher than supply reservoir, said method comprising the steps of:

(a) providing a discharge duct between the supply reservoir and the delivery reservoir; said discharge duct having an outlet and an inlet;

(b) positioning the said inlet of the discharge duct below a first minimum water level in the supply reservoir;

(c) positioning the said outlet of the discharge duct below a second minimum water level in the delivery reservoir;

(d) providing the discharge duct with a peak between the said outlet and said inlet and inclined sections leading from the peak towards the outlet and the said inlet respectively, said peak being located at a height between h+2d+0.5 to h+2d+8 meters where h represents the height difference between the floor levels of the supply and delivery reservoirs, and d the diameter of the cross section of the duct;

(e) said inclined sections being inclined at an angle between 45 and 60 degrees with reference to a virtual vertical axis passing through the peak;

(f) providing a siphon breaking orifice at the peak or within 5 degrees of the peak with reference to a axis passing through the peak;

(g) providing a controlled evacuator orifice within 10 to 17 degrees off the axis passing through the peak;

(h) pumping water from the supply reservoir to the delivery reservoir via the discharge duct;

(i) evacuating air pocket formed in the discharge duct, via the evacuator orifice to set up reduced head flow between the supply reservoir and the delivery reservoir; and (j) in the case of a sudden stoppage, breaking the reverse flow occurring in the discharge duct as a result of siphon action by introducing air at the peak via the said siphon breaking valve.

The discharge duct in accordance with this invention is a unique configuration involving two phase flows during start up of the pumping unit and during sudden stopping of the unit due to power failure. The evolution of the discharge duct is based on a combination of the principles of Froude Similarity, Reynolds Similarity and the computational approach.

The discharge duct in accordance with this invention is devised after careful experiments and application of concepts to correlate the results to prototypes.

The practical embodiment of the discharge duct of this invention is devised using model studies and calculations based partly on Froude Similarity and partly computational tools to arrive at sizing of equipment to establish the siphon and breaking of siphon for saving of valuable energy during pumping and saving of work already done after the sudden failure of power.

The two parameters i.e. the pressure levels at the interface and the volume contained in the cavity are used to finalize the sizing of the evacuator orifice nozzle and the siphon breaker valve orifice. In case of model tests the air is sucked using a vacuum pump. The vacuum pump is essential so as to suck air to still lower pressure than prevailing in the cavity. The evacuator system is designed using compressible flow analysis to arrive at nozzle size for the prototype.

This way the problem of air entrapment during starting of the pumping is resolved. In the absence of this device, the discharge duct would have had to be provided water supply to the line without establishing siphon action advantage for the discharge duct and wasting energy over the extra static head provided.

The invention also addresses the issue of the flow situation after sudden power failure. A significant feature of the system of this invention is that it dispenses with the use of a Non Return Valve or any device in the system to close down flow reversal. Siphon action gets established after power failure and flow direction is reversed. If this is allowed, huge amount of work already done in pumping water to higher elevation is lost.

To avoid this phenomenon, in accordance with this invention the siphon action is broken by injecting air. There is an advantage in this situation. The pressure in the duct is sub-atmospheric. Air can be injected by using a simple controlled vent at the peak which is opened immediately after power failure so that the siphon is not established. This results in breaking the siphon. However it is essential to ensure that sufficient air enters to break the siphon action. It is observed experimentally that if the air injected is not sufficient, water flowing with high velocity in reverse flow condition carries the air bubbles away without breaking siphon.

Air valves are chosen to supply sufficient quantity of air to achieve siphon breaking. The period of reverse flow operation should be limited to two to four seconds.

In embodiment envisaged in accordance with this invention NRV/butterfly valves are totally eliminated. This arrangement is required to overcome the serious problems during start up and unscheduled power failure.

It is impossible to conduct the experiment in the prototype because of the huge size of the pumping system. Instead a model is made out in proportion, to study the behaviour of flow in the duct.

The uniqueness lies in the fact that model study cannot be carried out based on Froude's similarity alone because it is not a free surface flow phenomenon. Reynolds similarity also will not be applicable in isolation because of two-phase flow. It is also difficult to use computation tools alone to resolve the matter as it involves transient flow studies with two-phase flow. It is possible to devise the sizes using a combination of all the above three methods using CFD.

A model study is conducted using Froude's similarity principle. A geometrical similar model can be used with appropriate flows to capture the phenomena of air entrapment during starting of the pump and reverse siphon action during abrupt power failure. A computational model representing the prototype is generated using a solid modeler. The air trapped in the prototype is estimated using the geometrical scaling in the computational model. For instance, the amount of the air to be removed from the discharge duct is found to be approximately 15 $m^3$ in a particular case. The compressible flow parameters are used to estimate the sizing of the air orifice in the evacuator orifice using appropriate coefficient of discharge.

Similarly, the sizing of siphon breaking arrangement is estimated from the quantum of air to be pushed in to effectively break the siphon in a relatively shorter time period. The volume of air to be injected in a particular experimental work to break the siphon was approximately 45.97 $m^3$.

The invention will now be described with reference to the accompanying drawings, in which FIG. 1 shows schematically a discharge duct in accordance with the prior art;

Figure 1:
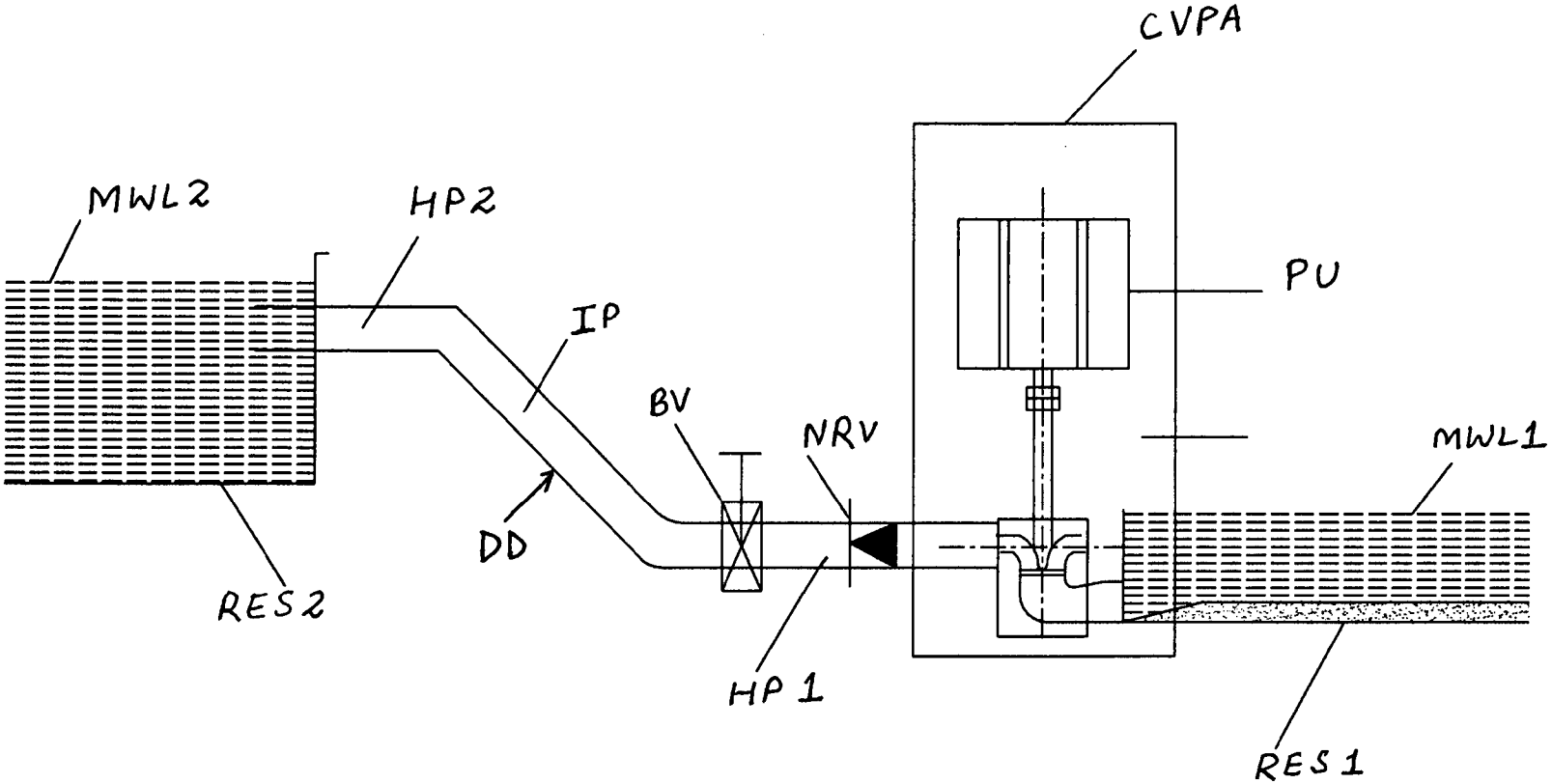

Referring to FIG. 1, of the drawings, there is generally shown a discharge duct DD configuration of the prior art, 100.

In the prior system 100 there is shown Components of a pumping system using conventional method are seen in FIG. 1 of the accompanying drawings in which is shown 1. Concrete volute pump assembly [CVPA] having a pump unit PU 2. At least two controlling valves over the discharge pipe (Non-return valve NRV and hydraulic/pneumatically control butterfly valve. BV)

3. Discharge duct, DD connecting pump CVPA from the supply reservoir RES1 having a minimum water level MWL1 to a delivery reservoir RES 2 having a minimum water level MWL2. The discharge duct is made up of two horizontal portions HP1 and HP2 connected to each other via an inclined portion IP.

Advantages of the prior art system shown in FIG. 1 is that it is a simple operating system The Control for the over flow/reverse flow is provided by the butterfly valve BV and the non ensures control of the reversal of flow when power fails/pump trips. The presence of the obstruction to the flow in terms of Non-Return Valve/Butterfly valve NRV is the source of head loss.

Figure 2:
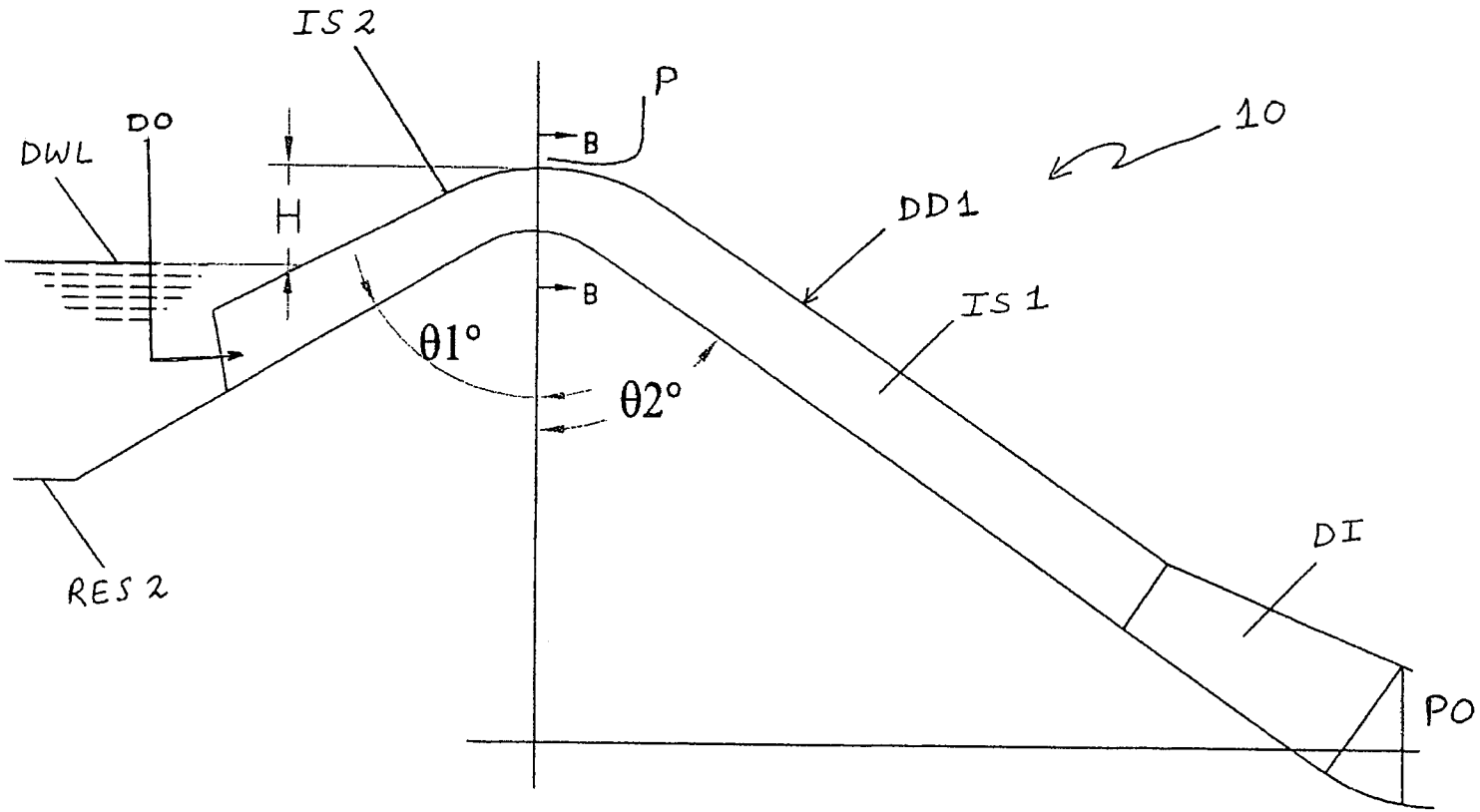
FIG. 2 shows the scheme of a discharge duct having a peak and inclined section leading from the peak in accordance with this invention.

FIG. 2 shows the scheme of a discharge duct 10 having a peak P in accordance with this invention. The concept of using siphon action is adopted in the scheme of this invention to save cost & energy by eliminating usage of Non-return & Butterfly valve in the discharge duct.

As seen in FIG. 2, the discharge duct DD1 envisaged in accordance with this invention comprises an inlet DI, outlet DO, a Peak P, inclined section IS1 leading from the peak P towards the inlet DI, and inclined section IS2 leading from the peak P towards the outlet DO. As seen in FIG. 2 the peak passes through an imaginary axis shown in the figure by the line 'BB'. The inclined angles θ1 and θ2 between the axis BB to inlet/outlet of the discharge duct can be within 45° to 60°. The inclined section IS1 is inclined at an angle of θ2°, whereas the inclined section IS2, θ1° to the imaginary axis BB. θ1 and θ2 vary between 45 and 60 degrees and are generally selected based on the general topography of the area. The duct inlet DI is connected to a pump outlet PO and the duct outlet DO is located below the delivered water level DWL of a delivery reservoir RES2. As seen in FIG. 2, the arrangement, avoids the use of the butterfly valve BY and the non return valve NRV of the prior art seen in FIG. 1.

Figure 3:
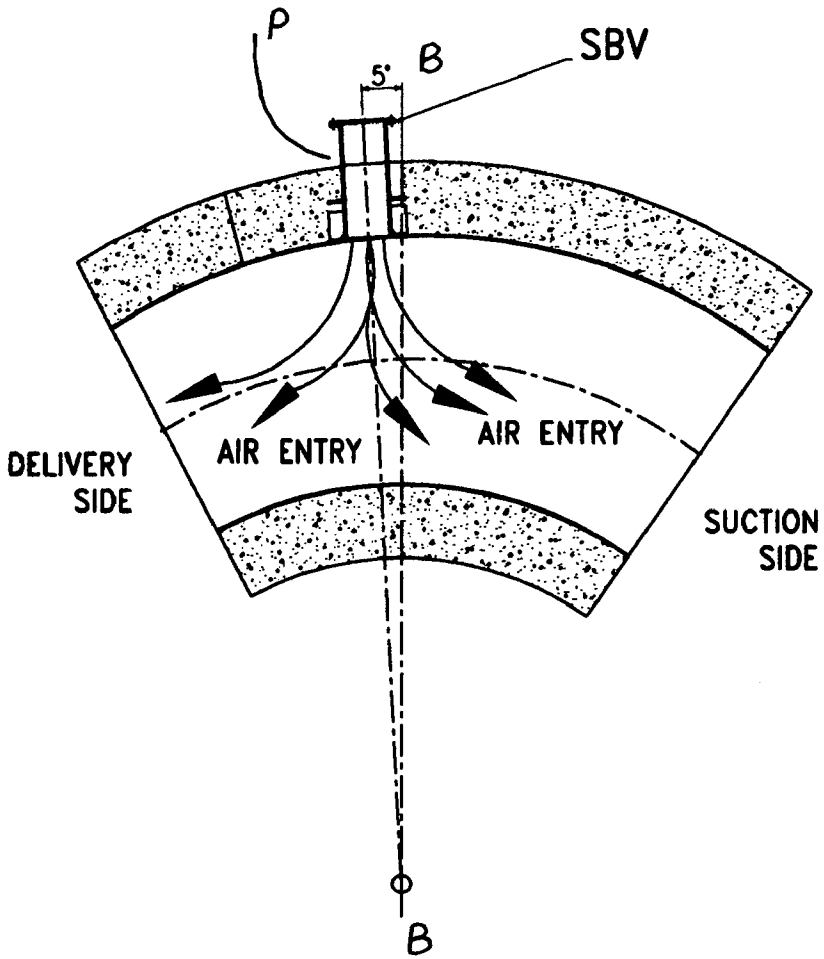
FIG. 3 shows a detailed view of the peak of FIG. 2 showing the suction breaker valve.
Figure 4:
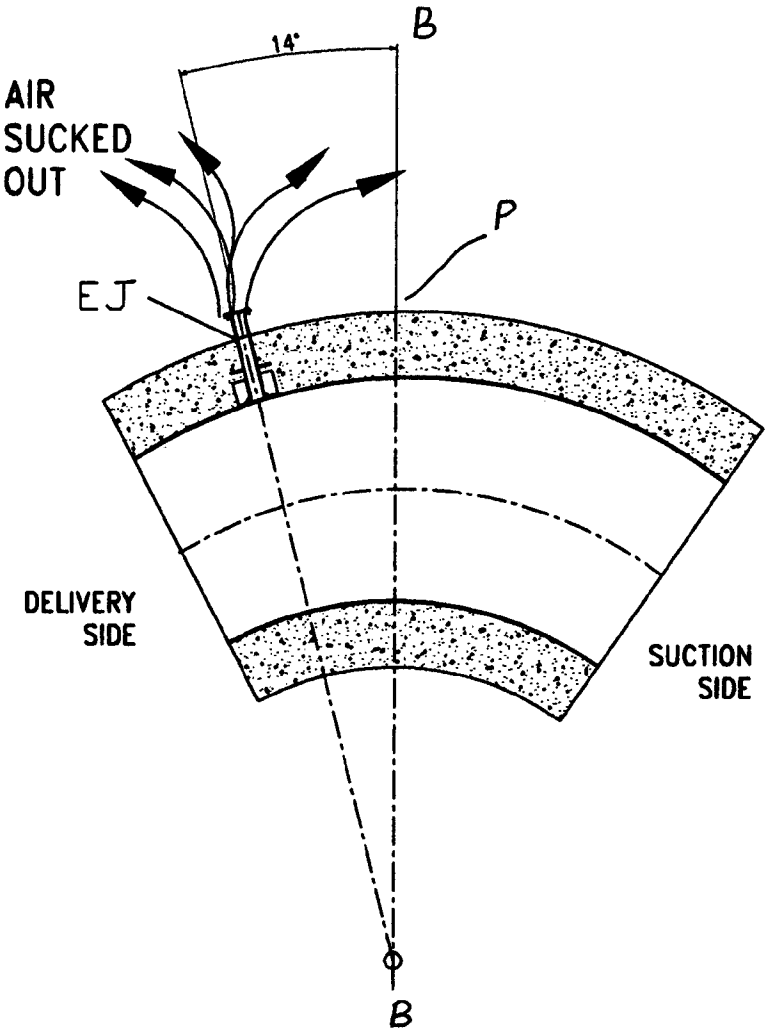
FIG. 4 shows a detailed view of the peak of FIG. 2 showing the evacuator valve.

FIG. 3, is a detailed view of the peak portion P of FIG. 2 in which the provision of a siphon breaking/orifice valve SBV is shown. In accordance with a preferred embodiment of this invention, the siphon breaker valve SBV is positioned at approximately 5 degrees off the peak P in the inclined section IS2 leading from the peak P towards the discharge outlet DO [deliver side]. FIG. 4, is a detailed view of the peak portion P of FIG. 2 in which the provision of an evacuator orifice EJ is shown. In accordance with a preferred embodiment of this invention, the evacuator orifice EJ is positioned at approximately 10 to 17 degrees and advantageously 14 degrees off the peak P towards the inclined section IS2 leading from the peak P towards the discharge outlet DO [deliver side]. As seen in both FIGS. 3 and 4, the peak P is arcuate and the inclined sections IS1 and IS2 from the suction side and the delivery side meet at the peak P along a continuous arc, although the peak may be at a level section or at a relative point. The peak P of the discharge duct from the pump datum is estimated from the atmospheric pressure of 10 m and giving margin for Vapor pressure, Dynamic head, Friction losses in the discharge duct. Therefore the peak level of the discharge duct to water level at the delivery reservoir advantageously lies between 0.5–8 m of the siphon height i.e the minimum water level MWL2 in reservoir RES2.

Figure 5:
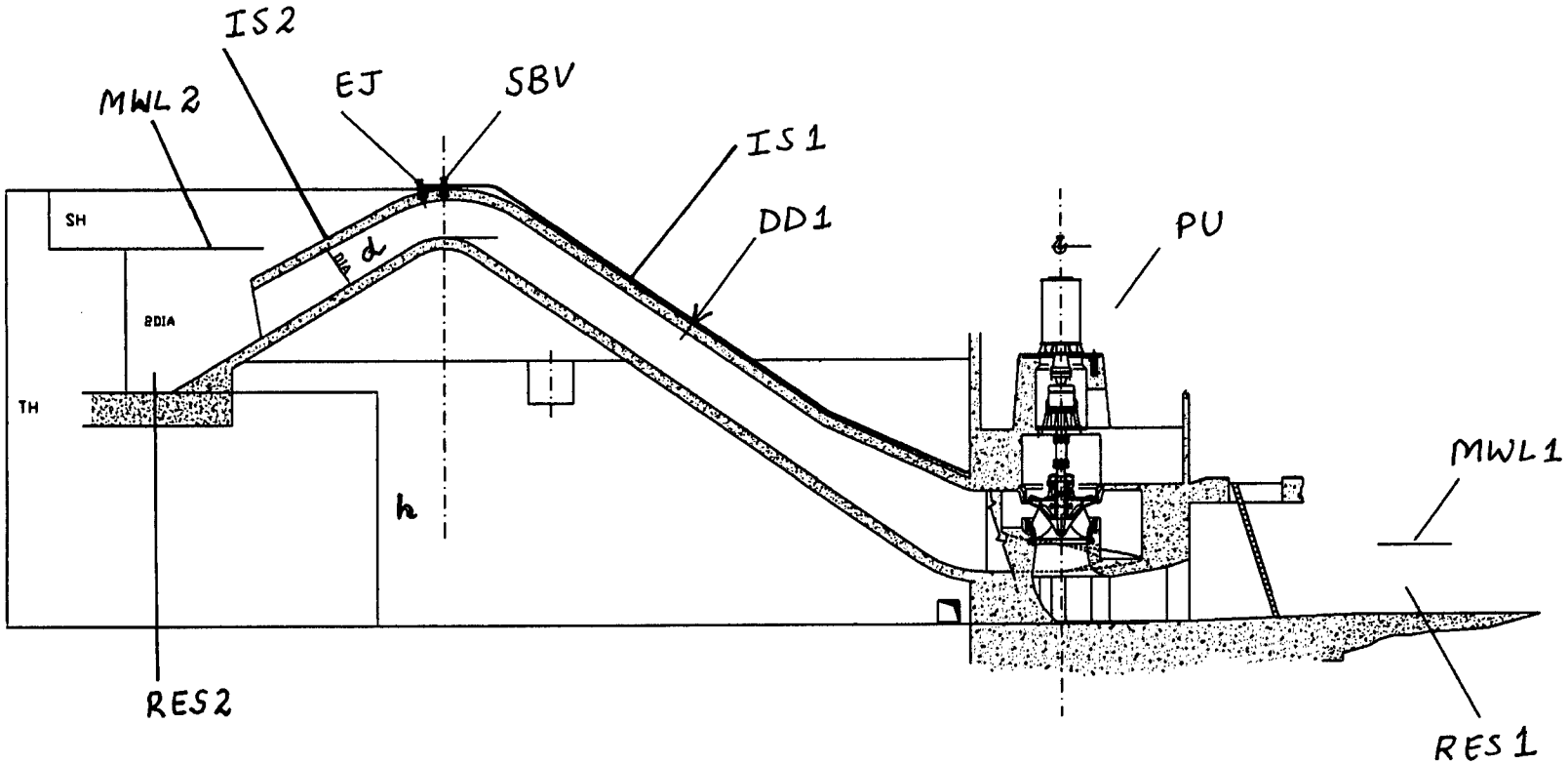
FIG. 5 shows an operative schematic view of the discharge duct of FIG. 2.
Figure 6:
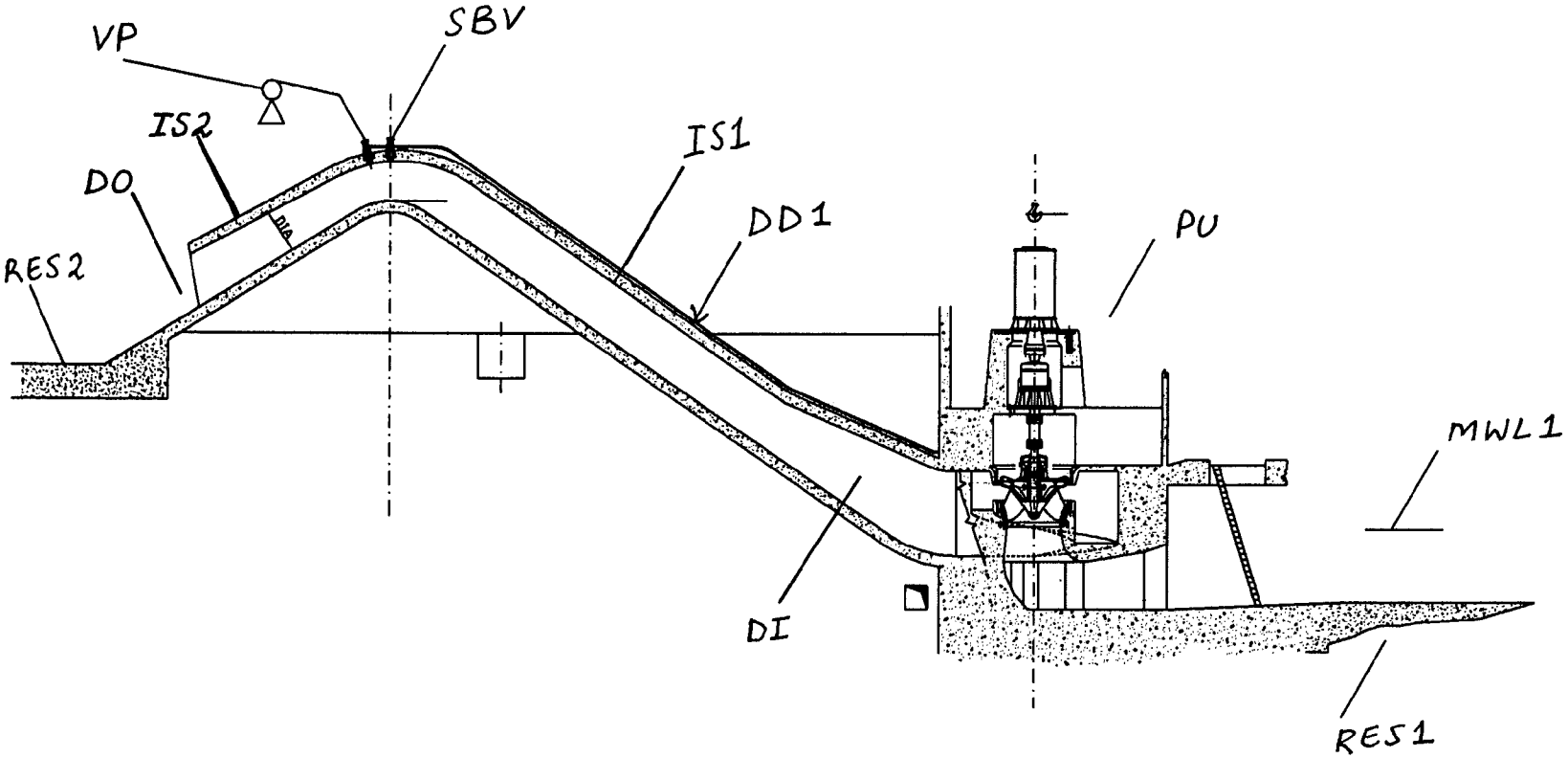
FIG. 6 shows the discharge duct of FIG. 5 with a vacuum pump fitted at the evacuator orifice.

FIGS. 5 and 6 show the scheme of a practical embodiment of the discharge duct in accordance with this invention. As seen in FIGS. 5 and 6 and particularly FIG. 5, the discharge duct DD1 is provided between a supply reservoir RES1 having a minimum water level MWL1 and a delivery reservoir RES2 having a minimum water level MWL2. The discharge duct DD1 may have a circular, oval or rectangular cross section, the cross section of the discharge duct is based on flow and velocity. The desired area of the cross section is pre-determined by ascertaining the capacity of the pump and the desirably velocity of the flow. Once the cross sectional area is ascertained it is possible to ascertain the diameter or the dimension in the operative vertical direction and this dimension such as the diameter d is noted. Hereinafter this dimension will be described by the term diameter d in the rest of the specification, but it is understood that this dimension represents the maximum dimension of the cross section of the duct in the vertical direction. The reservoir RES2 is at an operationally higher level than the reservoir RES1. As a starting step for providing the discharge duct DD1 the height difference between the respective floors of the two reservoirs RES1 and RES2 is determined and if this is found to be 'h'. The locational height TH of the peak P is then calculated by applying the formula height of peak P [TH]=[h+2d+(0.5 meters to 8 meters). The peak is selected on the basis of a suitable topographical point between RES1 and RES2 and as close as possible to RES2 based on actual site conditions.

The peak level P should be in the range of 0.5 M to 8 M from the water level MWL2 in the delivery reservoir RES2. The limit of 0.5 M come from the fact that below this there will not be any siphon action. The highest value of 8 M comes from the fact that the static pressure at the peak location will approach vapor pressure of liquid causing column separation and breaking of the siphon action.

From the peak inclined sections IS1 and IS2 lead towards the discharge inlet DI and discharge outlet DO respectively. The peak P lies on the imaginary axis BB and the inclined sections are inclined at angles θ1 and θ2 which are respectively 45 to 60 degrees with respect to the axis BB. A siphon breaker valve orifice SBV is provided as seen in the enlarged FIG. 3 at the peak or within a range of 5 degrees of the peak P. An air evacuator orifice EJ is provided in the range of 10 to 17 degrees of the peak and advantageously 14 degrees of the peak P. A vacuum pump VP may be provided at the air evacuator orifice EJ for further drawing out air.

The discharge duct DD1 has a flow in two phase (air plus water) at the start of pumping. The two phase flow features are derived from experimental studies and the single-phase flow features of CFD tools are used to estimate pressure levels, velocities etc.

The invention will now be described with reference to FIGS. 7 to 12 Down stream reservoir RES2 is empty)The deciding factors to select the pump head are as follows.

Static head (difference in water level at delivery to supply reservoir RES2 and RES Dynamic head Friction losses in the discharge duct.

Figure 7:
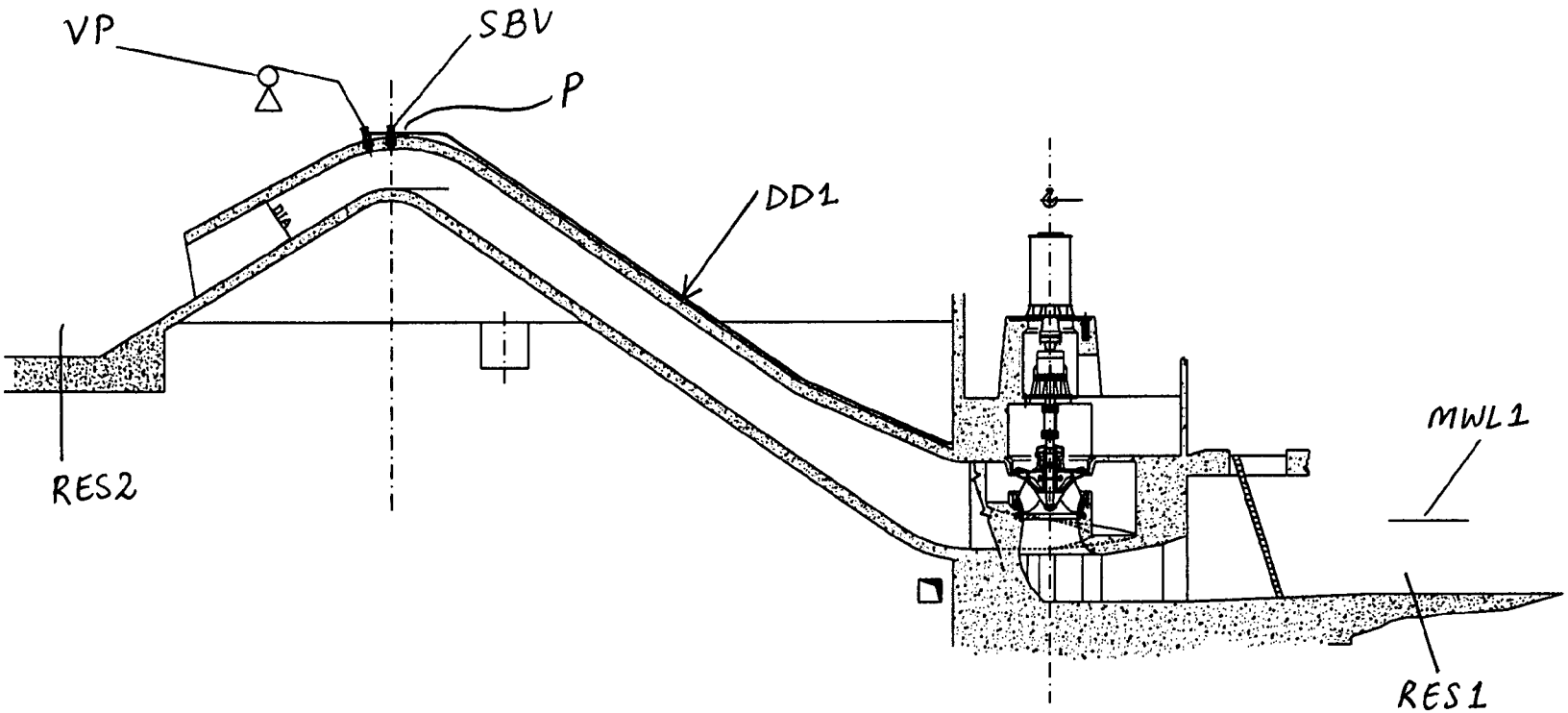
FIGS. 7 to 12 show the steps of the working of the discharge duct from the stopped condition to the condition when the set up of the normal delivery operations is complete.
Figure 8:
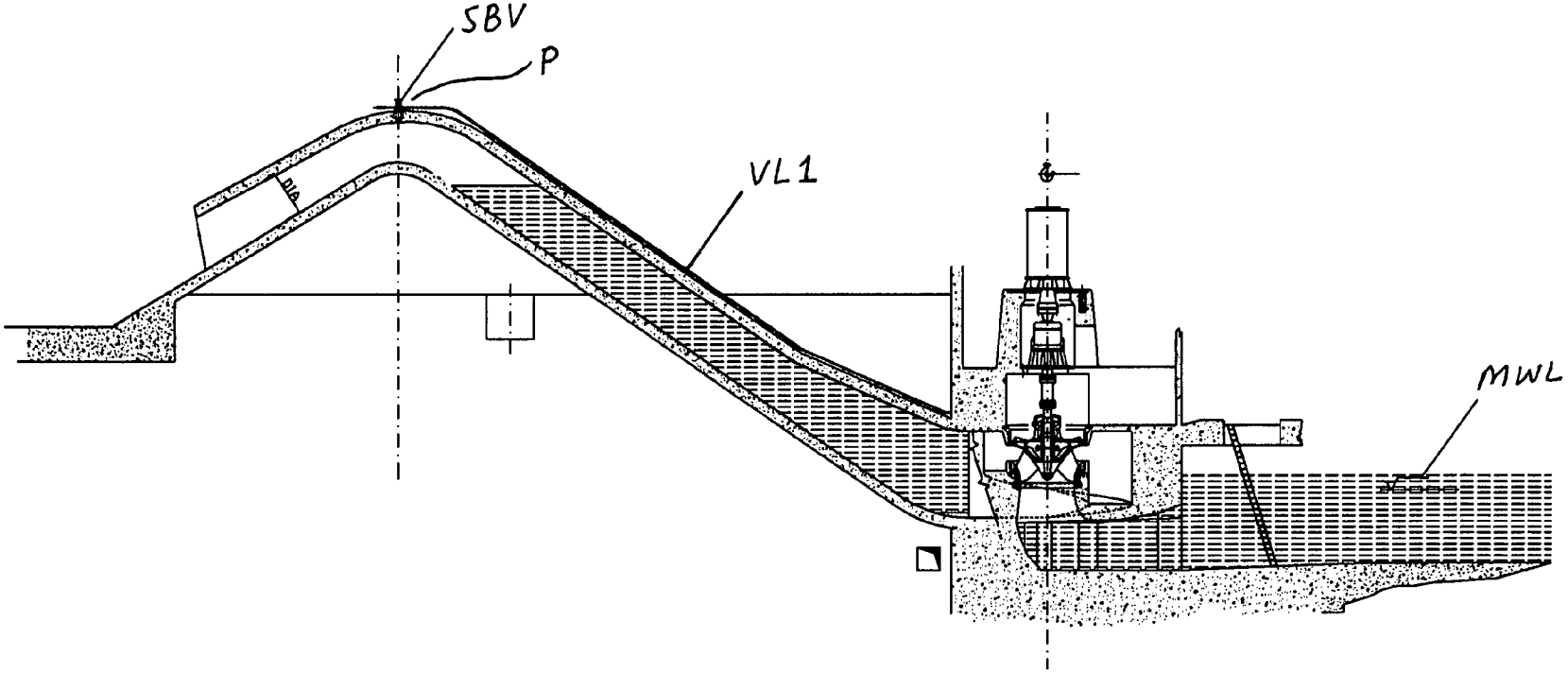
Figure 9:
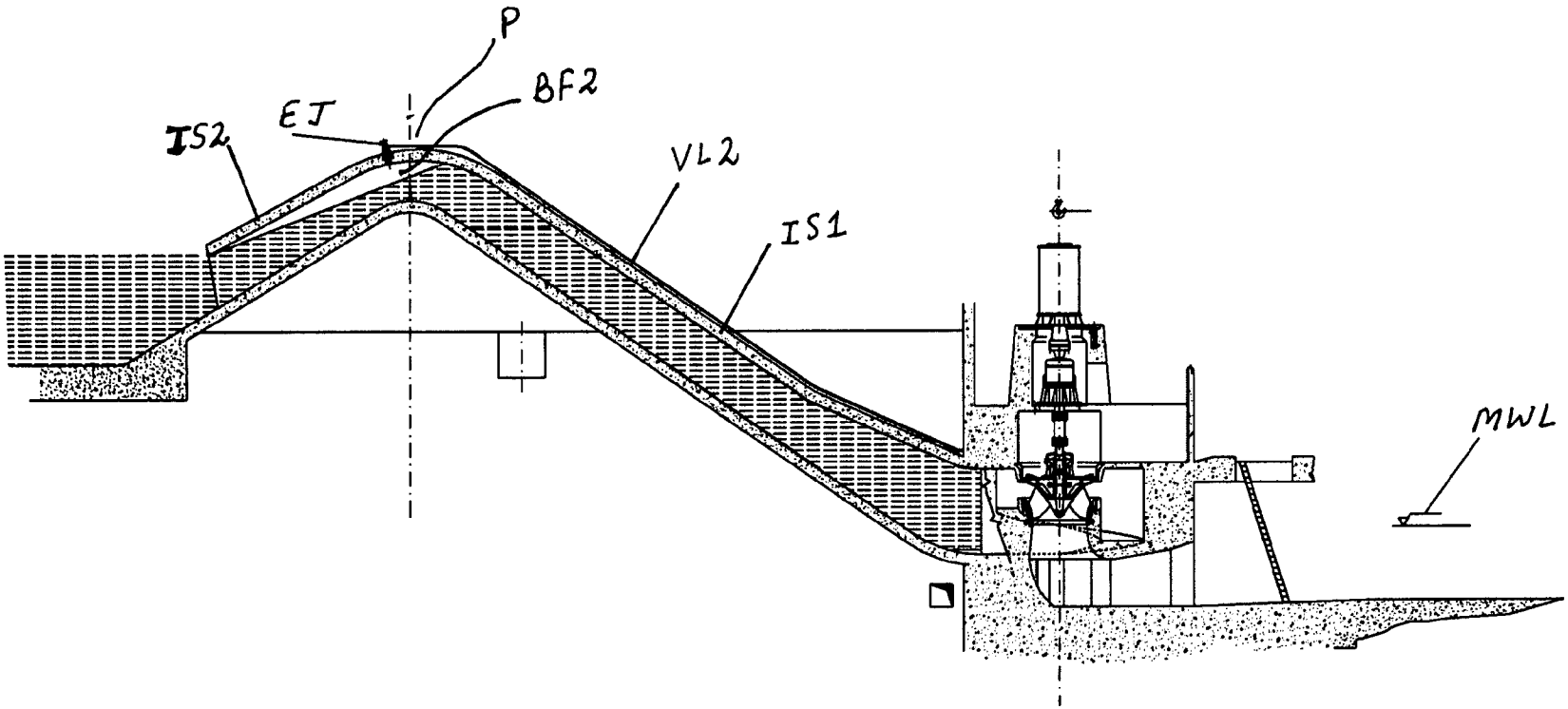
Figure 10:
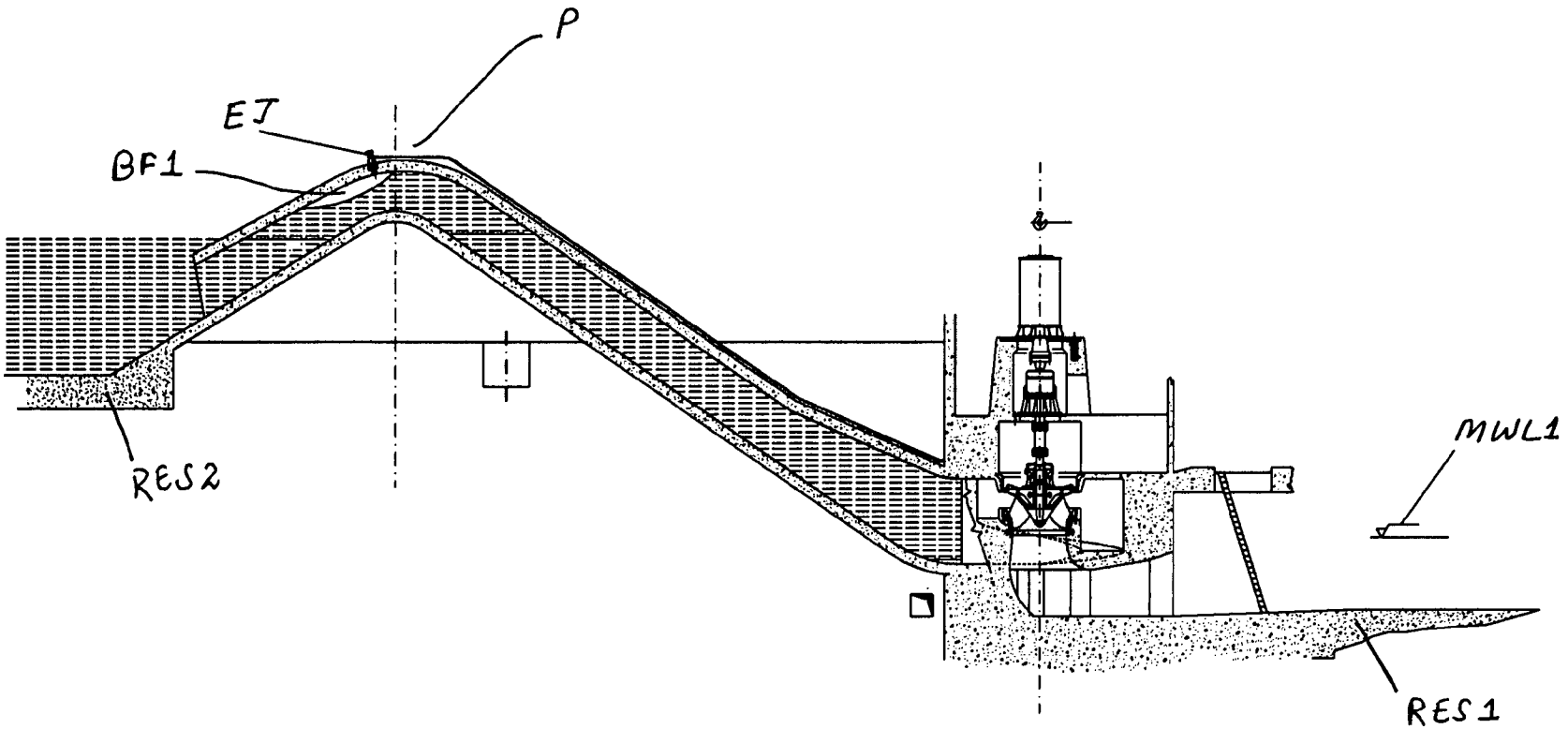
Figure 11:
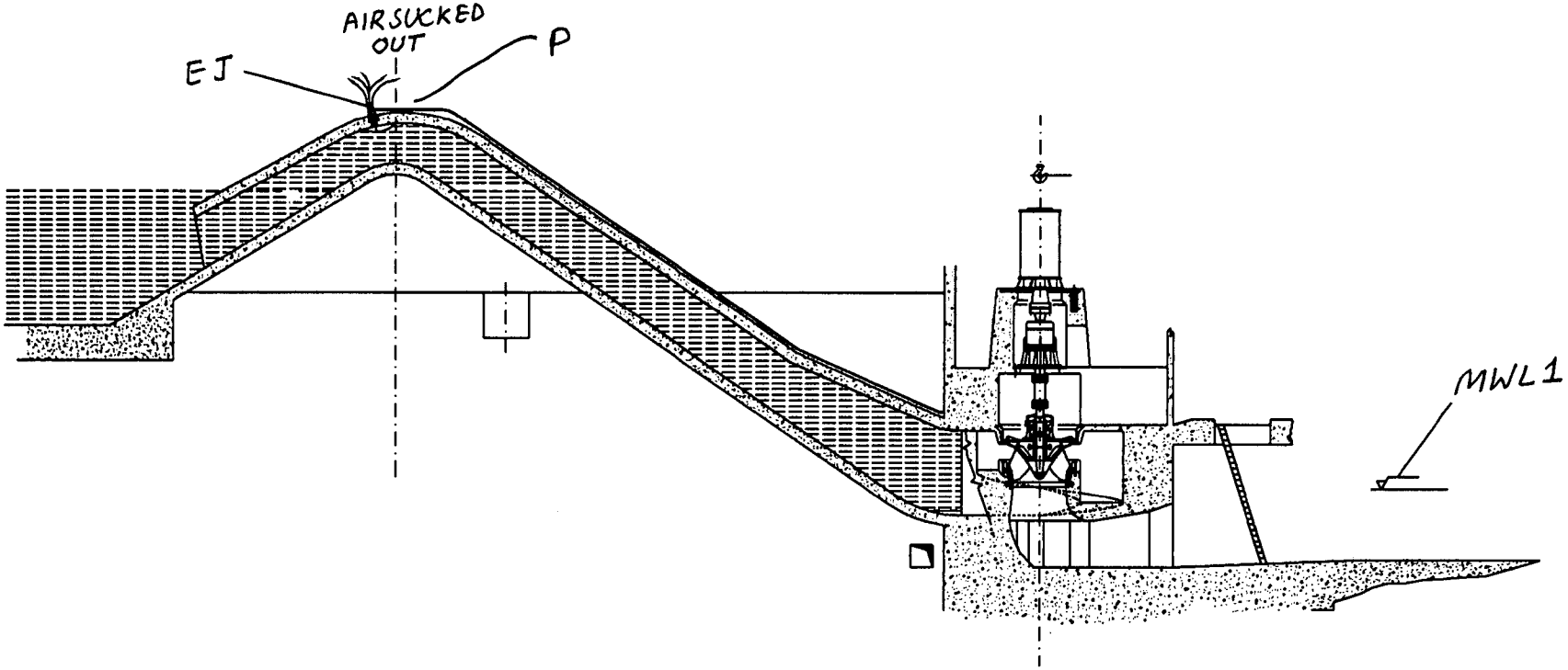

During pump first start condition, the discharged water starts to flow towards down stream reservoir RES2 with discharge duct partially filled. The remaining portion of the discharge duct will be filled with air. As the water level in the discharge duct increases above the opening of the discharge duct, the air in the discharge duct gets trapped. This air gets compressed and stays as a pocket near the peak position P of the discharge duct DD1. The presence of this bubble will not give the benefits of siphoning action and the pump will have much higher head than expected causing loss of power. One of the features of this invention is to remove this air pocket BF1. During start of the operations, as seen in FIG. 7 there is no water in the discharge duct DD1. Both valves SBV and EJ are shut. As the pump is switched on [FIG. 8] water starts rising in the discharge duct DD1. It reaches a stage at the peak elevation P [FIG. 9] of the inclined section IS1 of the discharge duct and starts flowing with duct partially filled with water and a free surface separated by air into inclined section IS2. The flow continues with such a condition till the water level in the discharge duct reaches the peak of the exit of discharge duct [FIG. 10]. At this period of time the water level in the duct starts rising with water flowing fully through discharge end of the duct occupying the entire outlet area with water. The air trapped in the duct cannot escape and gets compressed. A sizeable bubble BF1 is clearly visible. The interface between the water and air is slightly curved surface and the bubble BF1 is located towards downstream of the peak of discharge duct in the inclines section IS2.

The height of the air bubble from peak of the discharge duct is measured for various flow conditions. The volume of air trapped is estimated using a solid modeling software. The solid modeler has a capacity to bring out volume of the cavity formed by curved surfaces. The solid models are prepared for the geometrical models as well as prototypes. Knowing the shape of the duct and the height of interface between air and water from the peak position, the volume of the cavity is brought out from solid model. Using the same scale ratio the air trapped in prototype is estimated from the solid model. The angles of inclination 01 and 02 are optimized to collect the air bubble BF1 at the peak so as to ease the evacuation of entrapped air at the evacuator EJ and also to ensure a smooth flow during pump operation. During experimental studies it has been observed that the collection of air is at the peak more towards the exit of discharge duct in the inclined section IS2. Due to this reason the evacuator is positioned at an angle of 10 to 17 from the peak of the discharge duct.

Figure 12:
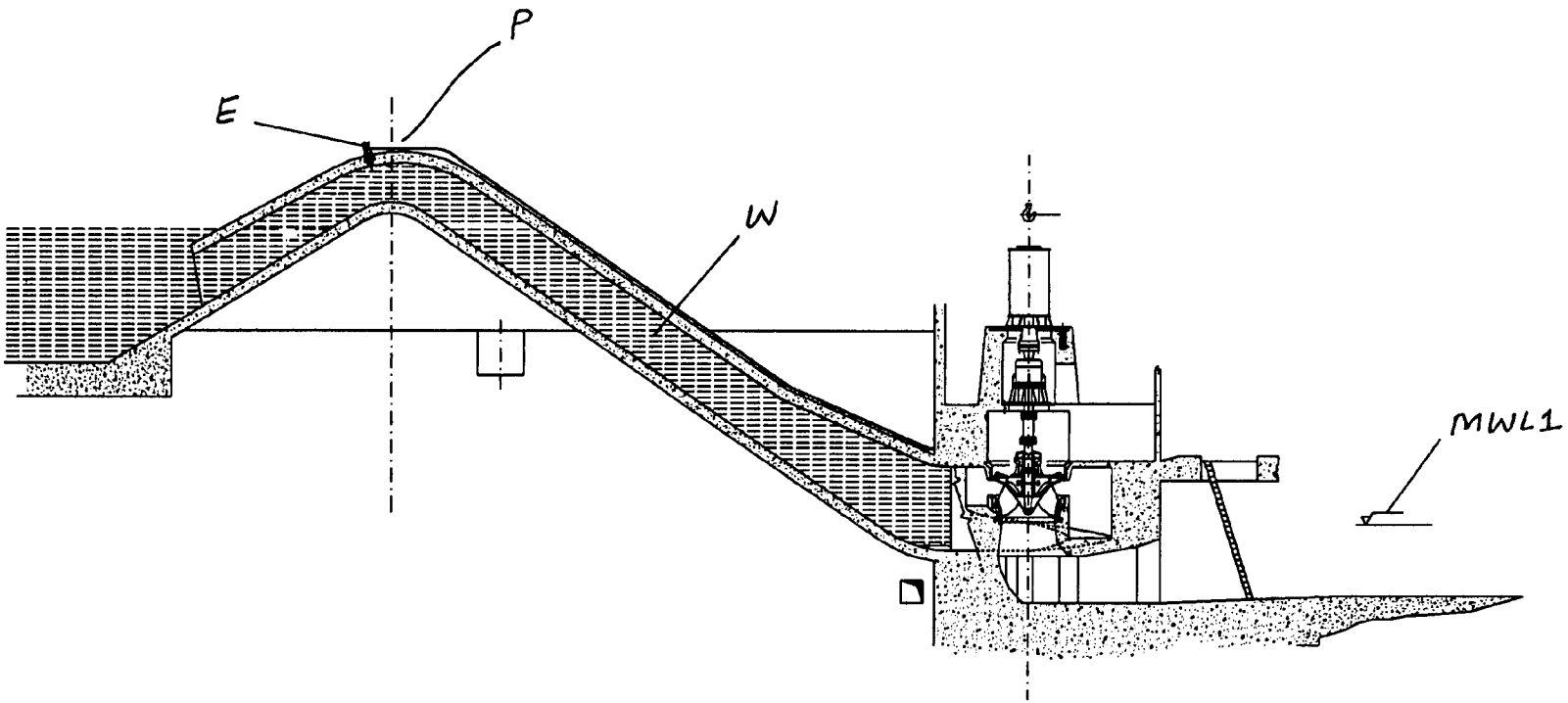

To remove the compressed air bubble/air pocket BF1, the evacuator valve EJ is actuated by means of the Lever VL1. This causes the compressed air to be evacuated. A vacuum pump VP may be fitted advantageously to the evacuator valve EJ to assist in the evacuation of air from the air pocket BF1. Once all air is evacuated a single water column W as seen in FIG. 12 is formed which flows from the reservoir RES1 to the reservoir RES2.

Figure 13:
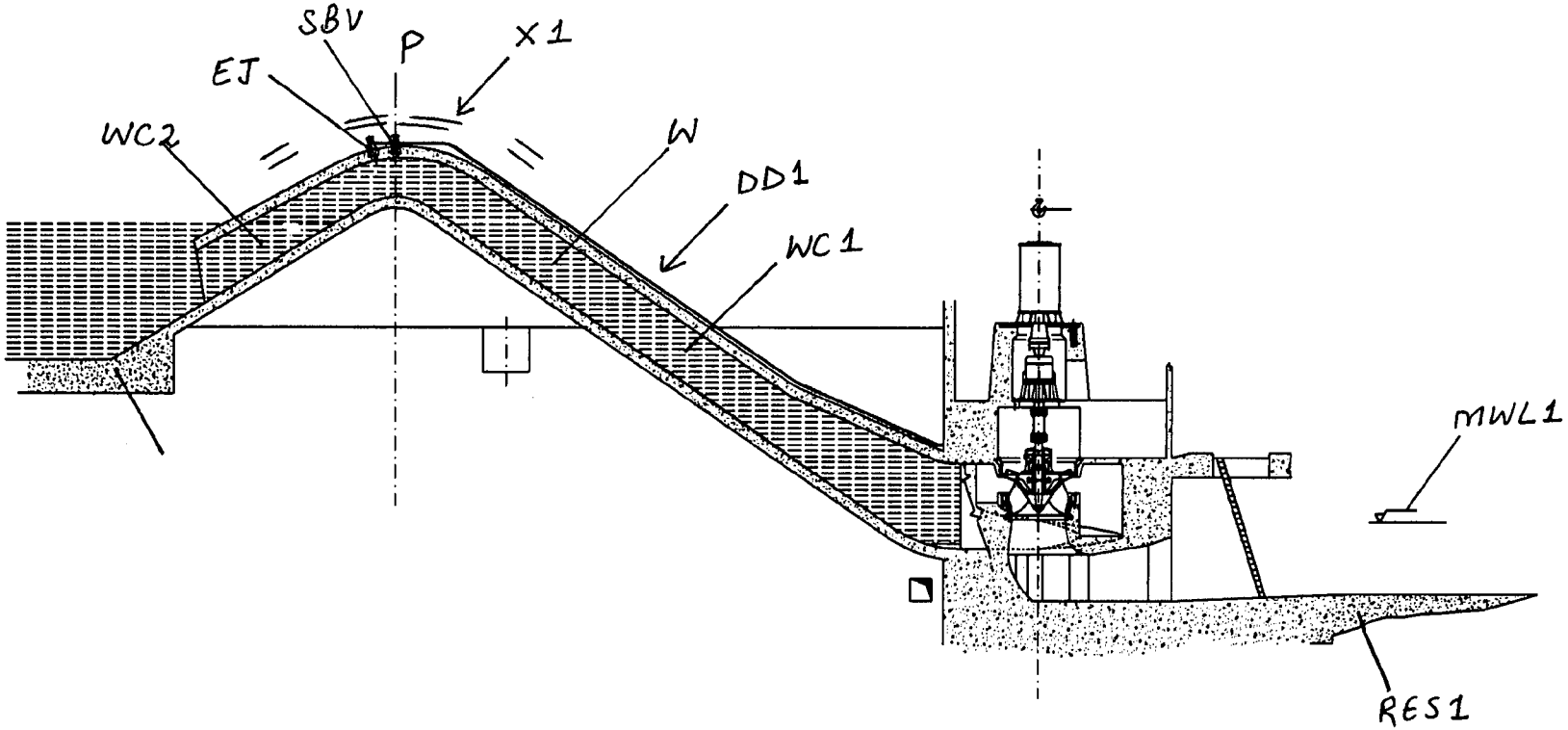
FIGS. 13 to 18 show steps of the working of the discharge duct in the event of sudden stoppage of the normal delivery operations.
Figure 14:
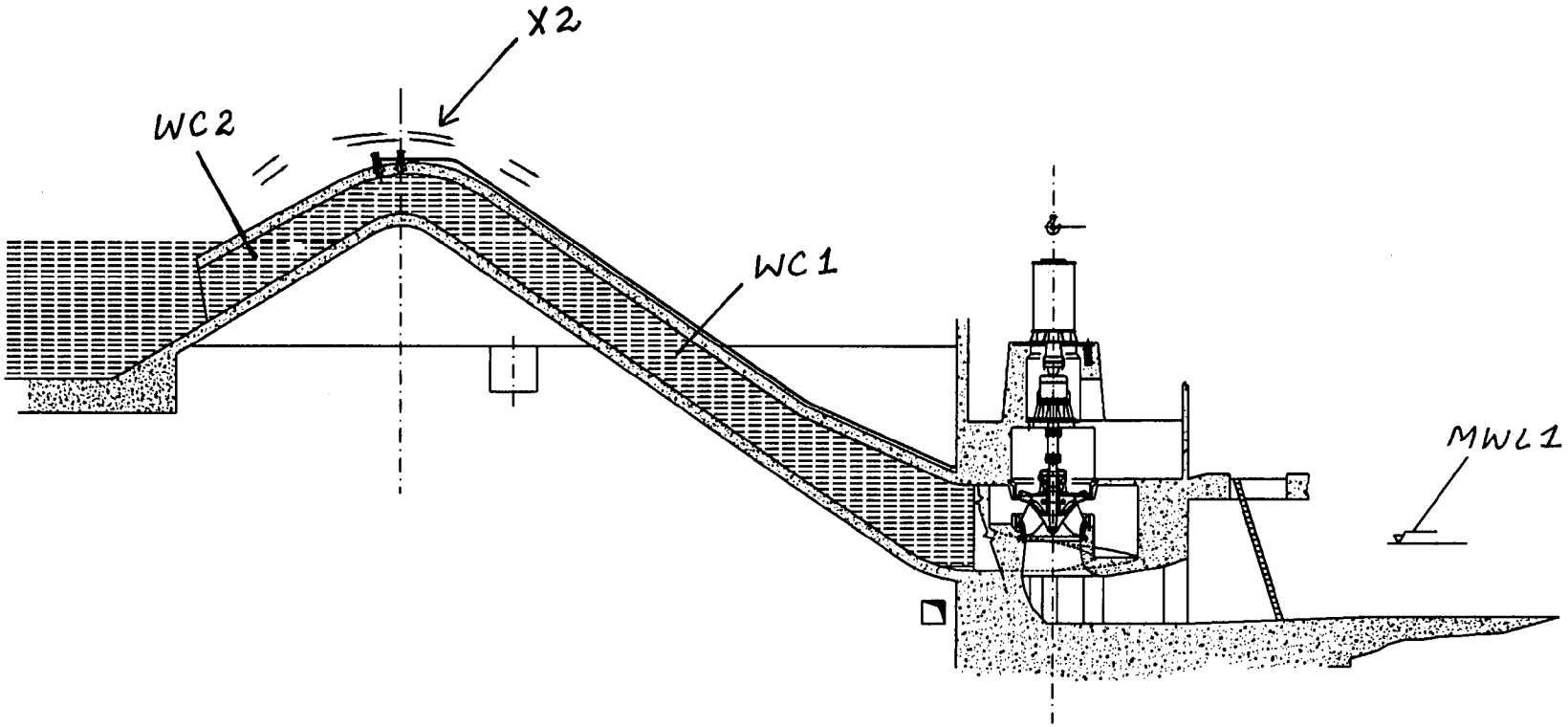
Figure 15:
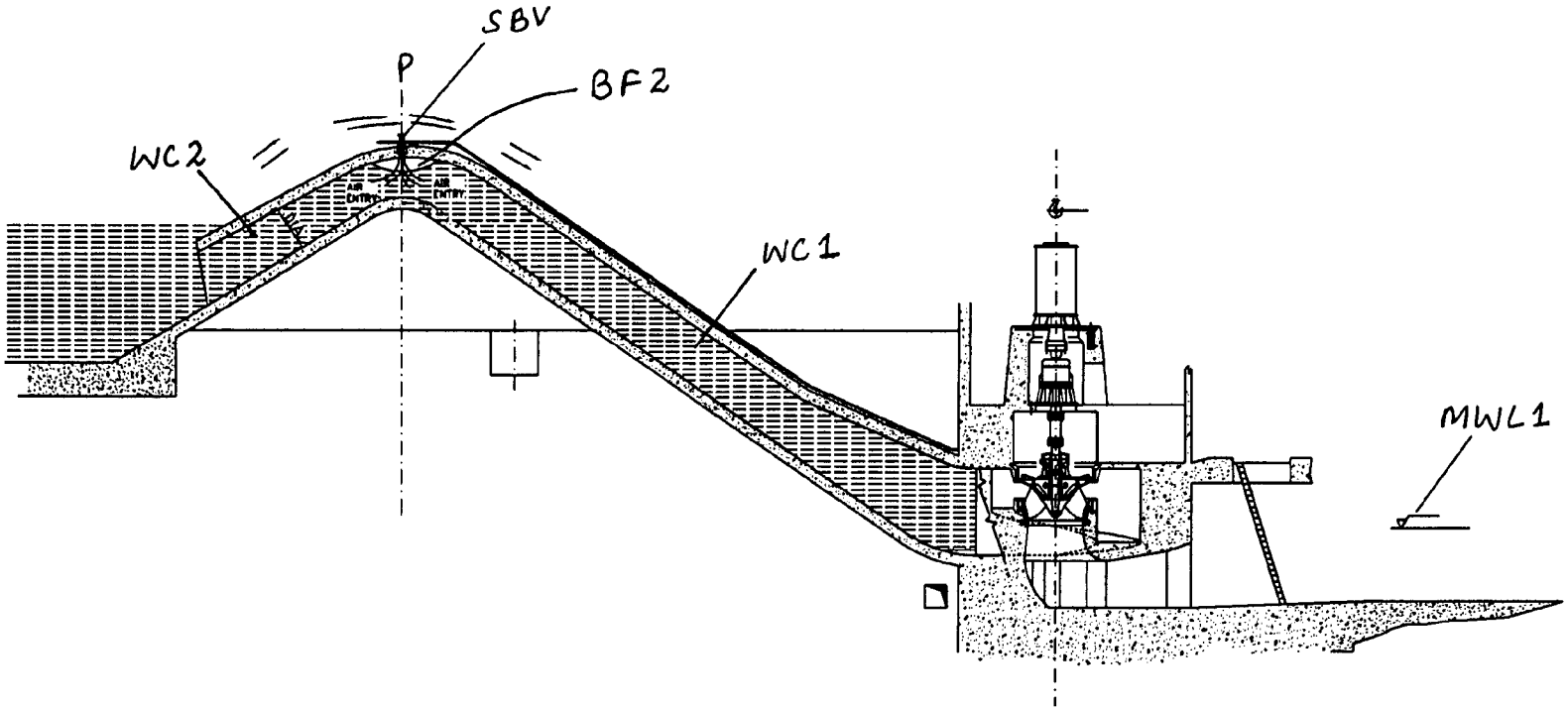
Figure 16:
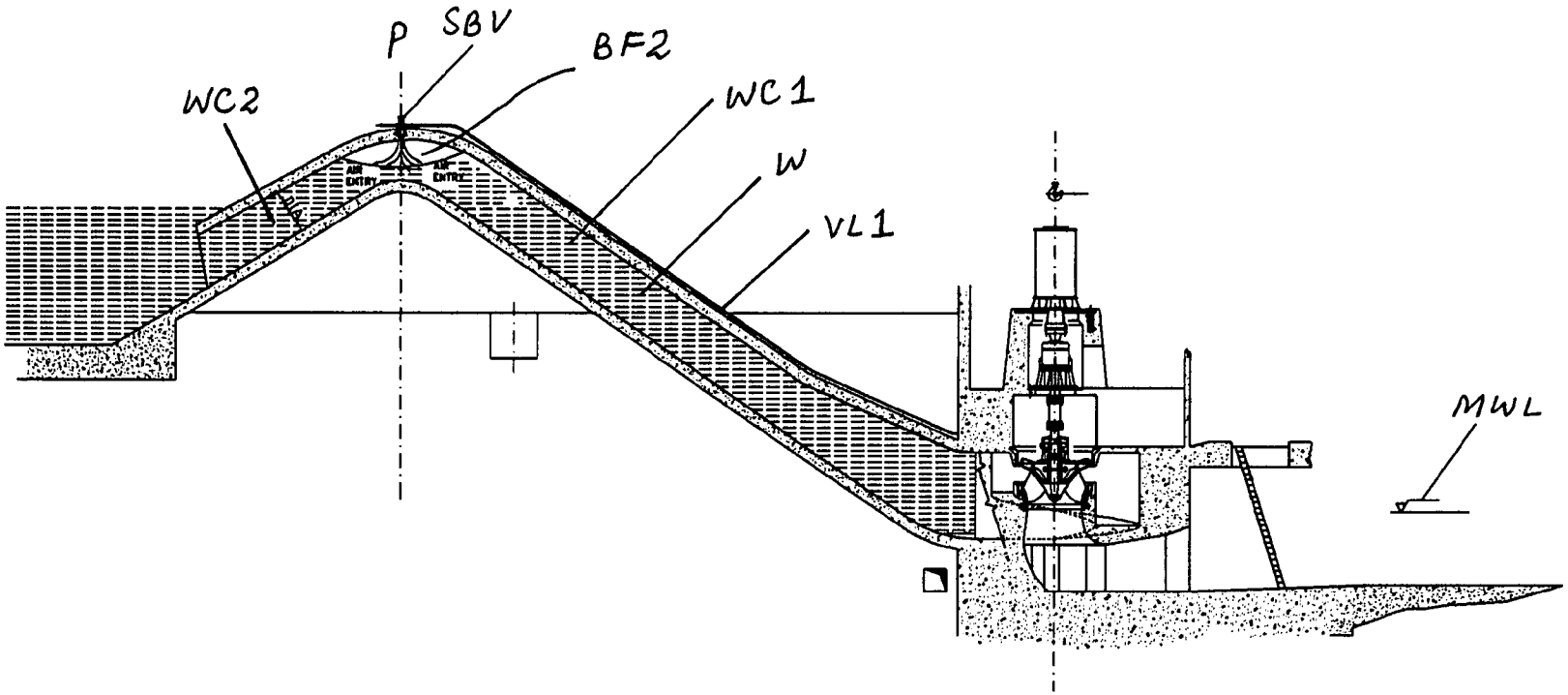
Figure 17:
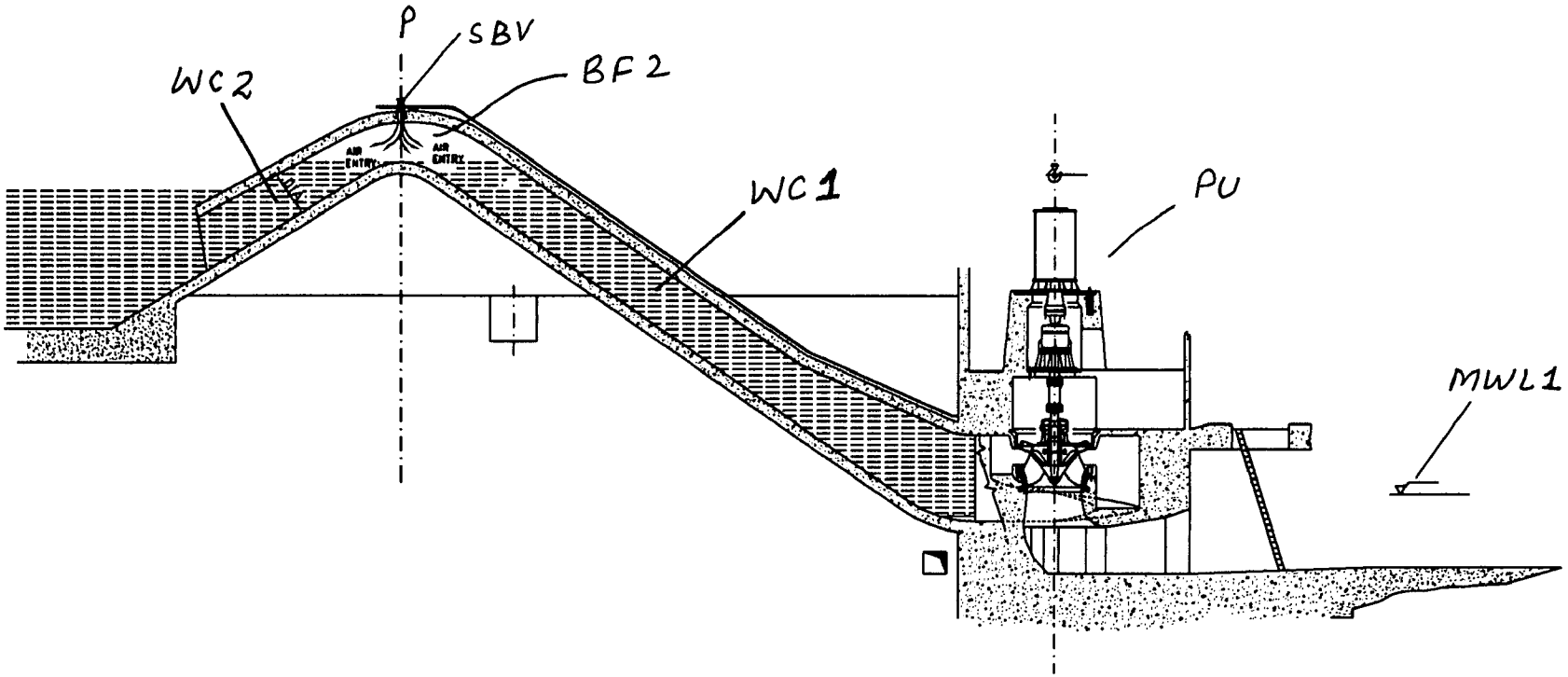

FIGS. 13 to 18 illustrate the working of the discharge duct in accordance with this invention when power fails. In FIG. 13 is shown the normal working of the system and the water flow is illustrated by the direction arrows X1 flowing from Reservoir RES1 to reservoir RES2. In this case there are two inclined water columns WC1 and WC2 which unify at the peak region. When power fails [as seen in FIGS. 14 to 18] the discharge flow will spontaneously reduce along with the pump speed. Naturally the water at higher level will start to flow towards lower level as reverse flow resulting as illustrated by the direction arrows X2. This causes the pump to rotate in reverse direction at a run away speed (as it is pump does not have ratchet mechanism to stop the pump rotate in the reverse direction.) The water, which was in the downstream, will now flow in the reverse direction [X2] due to siphon action resulting in waste of energy used in pumping the water. A principal feature of this invention is the arrangement to break the siphon, by allowing air at the peak location, thereby saving energy and cost during the unplanned pump stop or power failure conditions.

Figure 18:
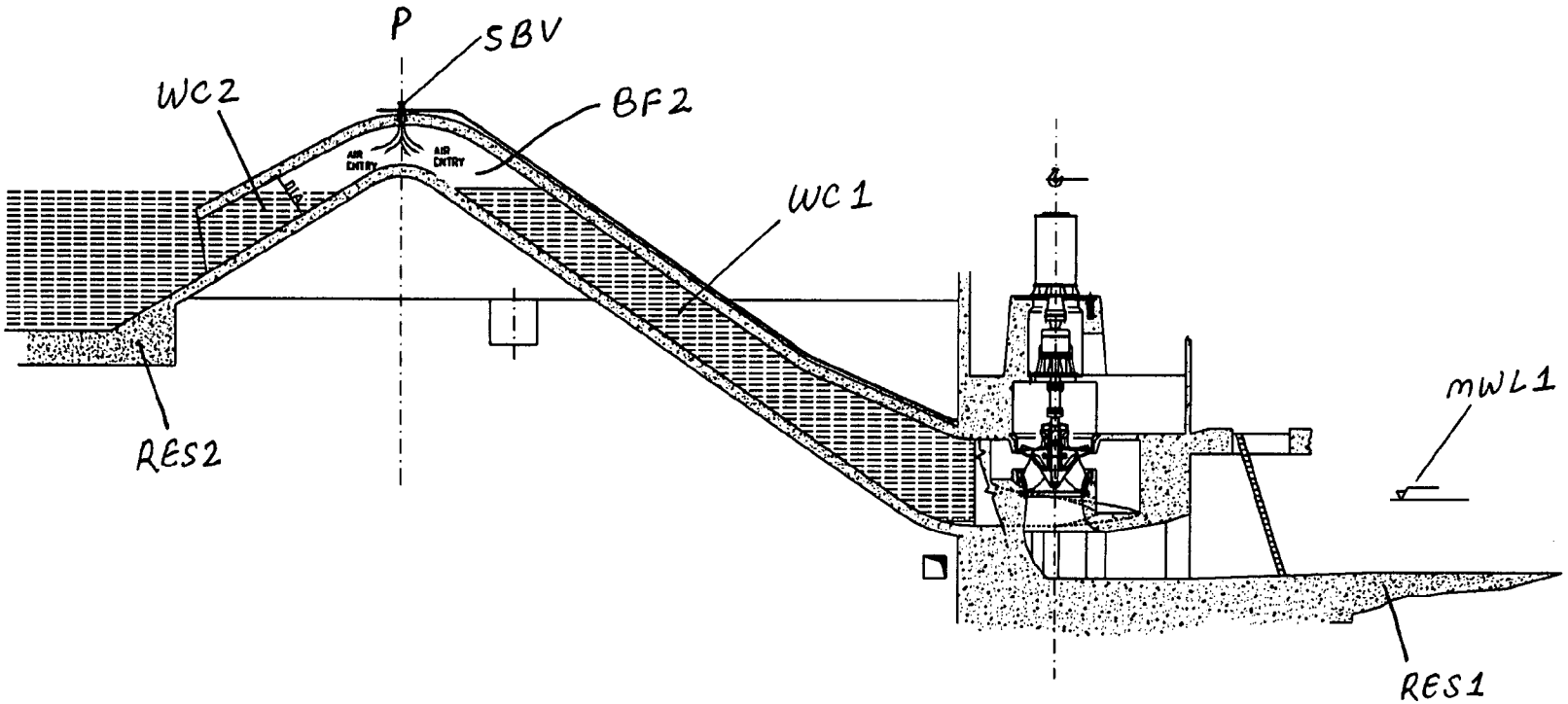

A siphon breaking valve SBV is provided at the peak P or within five degrees off the peak towards the discharge reservoir RES2 in the inclined section IS2. Siphon breaker valve SBV is typically a pneumatic controlled valve with a separate power back up of direct current solenoid valve. And can be controlled by actuating lever VL1 from the pump station at the Reservoir RES1. This will operate in preset time when the power goes off in the pumping station. Also it has advantageously a fail proof opening mechanism if it fails to open in preset time. When valve SBV is actuated air is introduced into the peak area P and forms a bubble BF2 between the water columns WC1 and WC2. This bubble BF2 enlarges as more air is sucked in as seen in FIGS. 15 to 18 until finally as seen in FIG. 18 the two water columns are completely separated. Thus water is prevented from returning to the reservoir RES1. This is achieved without the use of a non return valve.

Preferred velocity in pipes ranges from 2–3 m/s. This means for a flow of 4 $m^3$/s to 6 $m^3$/s the diameter will range from 1.3 m to 1.95 m respectively. Therefore advantageously the discharge duct is practically designed to have a velocity of 2 m/s.

Experiments were carried out to compute the different values for selected discharge ducts in accordance with this invention which are shown in the table below where cases refer to actual examples of ducts which were fitted between a supply reservoir and a discharge reservoir.

| Cases | Cross section B-B (m × m) | Vertical height in meters, (m) | Flow ($m^3$/hr) |
|---|---|---|---|
| Case-1 | 4 × 2 | 8 | 72,000 |
| Case-2 | 3.5 × 1.75 | 6.5 | 60,000 |
| Case-3 | 3 × 1.5 | 5.5 | 45,000 |
| Case-4 | 2.5 × 1.25 | 4.5 | 35,000 |

It is impossible to conduct the experiment in the prototype because of the huge size of the pumping system. Instead a model is made out in proportion, to study the behaviour of flow in the duct.

The uniqueness lies in the fact that model study cannot be carried out based on Froude's similarity alone because it is not a free surface flow phenomenon. Reynolds similarity also will not be applicable in isolation because of two-phase flow. It is also difficult to use computation tools alone to resolve the matter as it involves transient flow studies with two-phase flow. It is possible to devise the sizes using a combination of all the above three methods using CFD.

A model study is conducted using Froude's similarity principle. A geometrical similar model can be used with appropriate flows to capture the phenomena of air entrapment during starting of the pump and reverse siphon action during abrupt power failure. A computational model representing the prototype is generated using a solid modeler. The air trapped in the prototype is estimated using the geometrical scaling in the computational model. For instance, the amount of the air to be removed from the discharge duct in the aforesaid cases was found to be approximately 15 $m^3$. The compressible flow parameters are used to estimate the sizing of the air orifice in the evacuator orifice using appropriate coefficient of discharge. The diameter of the evacuator orifice was 300 mm. By placing suitable reducer means the bore of the orifice can be reduced.

Similarly, the sizing of siphon breaking arrangement is estimated from the quantum of air to be pushed in to effectively break the siphon in a relatively shorter time period i.e. 2 to 4 seconds. The volume of air to be injected in the particular experimental work to break the siphon was approximately 45.5 to 46 $m^3$. The diameter of the siphon breaking orifice was 600 mm. By placing suitable reducer means the bore of the orifice can be reduced.

The inventors of the present invention worked on investigating these flow features by conducting a model experiment combined with latest computational tools and correlated the results to large scale prototypes handling 72000 M^3/Hr flow.

In the method of making the discharge duct of this invention a transparent model was constructed using Froude Similarity principal. The model ratio is chosen to make the experiments practical. The model is constructed typically with a geometrically similar discharge duct with 150-mm diameter/duct width.

The operating flow for the ducts was estimated from Froude Similarity. The cases of Concrete Volute pump and Vertical Pump were modeled separately as the geometry and flow conditions are different for both these units.

While considerable emphasis has been placed herein on the structures and structural interrelationships between the component parts of the preferred embodiments, it will be appreciated that many embodiments can be made and that many changes can be made in the preferred embodiments without departing from the principles of the invention. These and other changes in the preferred embodiment as well as other embodiments of the invention will be apparent to those skilled in the art from the disclosure herein, whereby it is to be distinctly understood that the foregoing descriptive matter is to be interpreted merely as illustrative of the invention and not as a limitation.

The invention claimed is:

1. A discharge duct for discharging pumped water from a supply reservoir defined by a first minimum water level and a supply reservoir floor to an operatively higher located delivery reservoir defined by a second minimum water level and the delivery reservoir floor, said discharge duct being defined by:

an inlet at one end of the discharge duct in communication with the outlet orifice of a conventional pumping device fitted at the supply reservoir, an outlet at the other end of the discharge duct, said outlet, in the operative configuration of the discharge duct, being below the second minimum water level;

a peak at a location relatively closer to the delivery reservoir and at a height between h +2d +0.5 meters and h +2d +8 meters where h represents the height difference between the floor levels of the supply reservoir and the delivery reservoir and 2d represents the diameter of the cross section of the discharge duct;

inclined sections leading from the peak towards said inlet and said outlet, the angle of inclination of the inclined sections leading to said outlet and said inlet being at an angle lying between 45 and 60 degrees to a virtual central axis [B—B] passing through the said peak;

a siphon breaking orifice provided at the peak or within five degrees of the peak towards the delivery reservoir; and an evacuator orifice provided at a location on the inclined section leading from the peak towards the said outlet at a position 10 to 17 degrees off the peak towards the delivery reservoir.

2. A discharge duct for discharging pumped water as claimed in claim 1, in which the discharge duct of said peak is arcuate.

3. A discharge duct for discharging pumped water as claimed in claim 1, in which a pneumatic controlled valve with a separate power back up is fitted to the siphon breaking orifice.

4. A discharge duct for discharging pumped water as claimed in claim 1, in which a vacuum pump is provided at the evacuator orifice.

5. A method of delivering water through a discharge duct from a supply reservoir to a delivery reservoir located at a level operationally higher than the supply reservoir, said method comprising the steps of:

(a) providing a discharge duct between the supply reservoir and the delivery reservoir; said discharge duct having an outlet and an inlet;

(b) positioning said inlet of the discharge duct below a first minimum water level in the supply reservoir;

(c) positioning said outlet of the discharge duct below a second minimum water level in the delivery reservoir;

(d) providing the discharge duct with a peak between said outlet and said inlet and inclined sections leading from the peak towards the outlet and the said inlet respectively, said peak being located at a height between h +2d +0.5 to h +2d +8 meters where h represents the height difference between the floor levels of the supply and delivery reservoirs, and d the diameter of the cross section of the duct;

(e) said inclined sections being inclined at an angle between 45 and 60 degrees with reference to a virtual vertical axis passing through the peak;

(f) providing a siphon breaking orifice at the peak or within 5 degrees of the peak with reference to an axis passing through the peak;

(g) providing a controlled evacuator orifice within 10 to 17 degrees off the axis passing through the peak;

(h) pumping water from the supply reservoir to the delivery reservoir via the discharge duct;

(i) evacuating air pocket formed in the discharge duct, via the evacuator orifice to set up reduced head flow between the supply reservoir and the delivery reservoir; and (j) in the case of a sudden stoppage, breaking the reverse flow occurring in the discharge duct as a result of siphon action by introducing air at the peak via the said siphon breaking valve.

* * * * *